United States Patent [19]

Ruud et al.

[11] 4,065,667

[45] Dec. 27, 1977

[54] INDIRECT LIGHTING FIXTURE INCLUDING IMPROVED REFLECTOR

[75] Inventors: Alan J. Ruud, West Allis, Wis.; Ian Lewin, Scottsdale, Ariz.

[73] Assignees: Donald L. Goulet, Wauwatosa; Alan J. Rudd, West Allis, both of Wis.

[21] Appl. No.: 631,514

[22] Filed: Nov. 13, 1975

[51] Int. Cl.[2] ..... F21S 1/02

[52] U.S. Cl. ..... 362/217; 362/297

[58] Field of Search ..... 240/41.35 R, 41.35 C, 240/41.35 D, 41.35 E, 73 R, 73 BC, 73 LD, 78 R, 78 G, 78 H, 78 LD, 78 LE, 103 R

[56] References Cited

U.S. PATENT DOCUMENTS

| | | | |
|---|---|---|---|
| 3,059,106 | 10/1962 | Moser | 240/78 H |
| 3,686,495 | 8/1972 | Medley | 240/41.35 E |
| 3,701,898 | 10/1972 | McNamara | 240/103 R |
| 3,746,854 | 7/1973 | Brass | 240/103 R X |

*Primary Examiner*—Fred L. Braun
*Attorney, Agent, or Firm*—James E. Nilles

[57] ABSTRACT

A light fixture for use in indirect lighting including a fixture assembly for supporting an elongated high intensity lamp in generally horizontally disposed relationship and including a reflector assembly for directing light from the lamp against an opposing surface in an evenly distributed pattern. The reflector assembly includes a pair of opposed side reflectors, opposed end reflectors adjacent the ends of the side reflectors, and diagonally disposed reflector panels which join the end reflectors to the side reflectors.

9 Claims, 7 Drawing Figures

INDIRECT LIGHTING FIXTURE INCLUDING IMPROVED REFLECTOR

BACKGROUND OF THE INVENTION

1. Field of Use

This invention relates to indirect lighting fixtures and more particularly to fixtures using high intensity lamps and including reflectors designed to direct the light at a surface such as a ceiling or wall.

2. Description of the Prior Art

Indirect lighting fixtures are well known wherein the fixtures are aimed or positioned such that the light source or lamp is not directly visible and light is dispersed by directing it at a ceiling or wall. The prior art fixtures, however, generally include a plurality of drawbacks and have not been adequately efficient to effectively replace direct lighting even though indirect lighting is preferable in many applications. The prior art fixtures have proved to be inefficient in part because they have failed to provide convenient and effective means to evenly disperse the light emitted by the lamps. For example, the intensity of the light emitted by the lamps and directed against a reflecting surface such as a ceiling or wall is often concentrated at a single point or in a plurality of definite areas rather than uniformly distributed across the area illuminated. Due to this uneven distribution of the light intensity striking the reflecting surface, the effeciency of such prior art lights is relatively low and they are unduly wasteful of energy. Other prior art light fixtures, which are somewhat more effective as means to evenly disperse the light, have used relatively large reflectors in an attempt to attain a more even distribution of light, but use of such large reflectors makes these lighting fixtures impractical.

SUMMARY OF THE INVENTION

The present invention provides an improved light fixture for use in indirect lighting which is efficient and compact and which provides for even distribution of light upon a relatively large area of the surface to be illuminated.

The light fixture of the invention employs a high intensity lamp which is disposed in a generally horizontal orientation and which is surrounded by a plurality of reflector surfaces. The reflector surfaces are particularly disposed such that the light emitted by the lamp and reflected by the surfaces is evenly distributed upon an opposed reflecting surface such as a ceiling or wall. The operation of the light fixture is based upon the assumption that the light emitted from the lamp which directly strikes the reflecting surface will tend to be brighter on that portion of the surface area closest to the lamp and that, in the absence of reflector means, the intensity of the light striking the areas away from this surface area will decrease with distance. In order to distribute the light intensity evenly across the entire area illuminated by the lamp, the reflectors of the light fixture provide means for directing an increasingly greater amount of the light to those portions of the illuminated area toward its periphery.

More particularly, the light fixture of the invention is comprised of a housing which supports a reflector cradle and a reflector assembly which includes a plurality of specifically arranged reflector panels. These reflector panels are arranged around the high intensity lamp and are specifically positioned such that, in combination, their reflector surfaces yield a uniform distribution of reflected light.

A significant advantage of the present invention is that the reflector panels are specifically positioned such that the light emitted by the light fixture is evenly distributed against the ceiling or wall reflecting surface thereby maximizing the efficiency of the lighting capabilities of the lamp in producing uniform lighting characteristics. The light fixture is also particularly efficient because the lamp is mounted horizontally therein and the lighting assembly can thus utilize more highly efficient high intensity lamps which must be positioned horizontally. The reflector cradle also provides a means for mounting the lamp such that the lamp can be variably positioned with respect to the reflector surfaces to thereby vary the width of the area illuminated.

A further advantage of the present invention over the prior art is that the lighting fixture can be of relatively compact construction yet disperse the light evenly over a wider surface area than is possible with the prior art fixtures. The light fixture of the invention can include reflector assemblies and reflector panels varying in size to accommodate lamps of 250–1,000 watts, with the size of the light fixtures and reflector assemblies varying proportionately to the size of the lamp used therein. Each of these light fixtures is proportionately more compact in construction than prior art optical assemblies housing similarly sized lamps. For example, a high intensity lamp of 400 watts can be received within a light fixture 8 inches in height. Similar prior art optical assemblies capable of housing a lamp of similar size were, of necessity, at least 13 inches high because the elongated lamps were mounted vertically therein.

The present invention provides an improved means of indirect lighting which is sufficiently efficient so as to make indirect lighting a practical and convenient way to light a room, and which makes indirect lighting of even large rooms a realistic objective. For example, the lighting fixtures can be used with particular advantage in retail stores where they may be mounted on top of shelving and directed at the ceiling. The use of this lighting technique will eliminate the need of ceiling lights and accompanying wiring and thus reduce building construction costs. The indirect lighting is also preferable in effect in that the glare of overhead lights is eliminated.

Additional advantages of the invention will become apparent from the following description of a preferred embodiment. The embodiment of the invention described is merely one of many alternative embodiments within the scope of the invention and should not be viewed as defining the limits of the invention.

DESCRIPTION OF A PREFERRED EMBODIMENT

Figure 1:
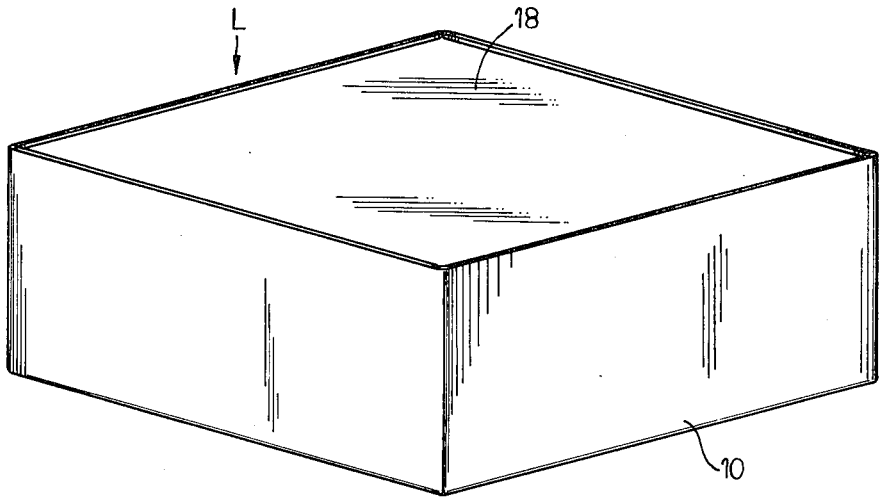
FIG. 1 is an isometric view of a preferred embodiment of the light fixture of the present invention.

The light fixture L of the present invention, as shown in FIGS. 1–5, generally comprises a fixture housing 10, a reflector support structure or reflector cradle 12, an elongated high intensity lamp 14 and a reflector assembly 16 supported by the reflector cradle 12 and surrounding the lamp 14. A refractory lense 18 may also be received across the reflector assembly 16 in order to aid in dispersing the light emitted by the lamp in a uniform pattern.

The light fixture is shown in FIGS. 1–4, as being positioned to radiate light upwardly against a ceiling (not shown) which functions as a reflecting surface. The light fixture is most effective and efficient if it is positioned at a distance on the order of 2–4 feet from the opposed reflecting surface. Thus, it is convenient to provide a support means (not shown) for the light fixture which is approximately 6 feet in height, wherein the light can be directed against a ceiling having a height within the range of 8–10 feet. Though the fixture can be used to radiate light against a ceiling, it should be readily apparent that the light fixture assembly of the invention would also be equally useful to direct light against a wall or the like.

Figure 2:
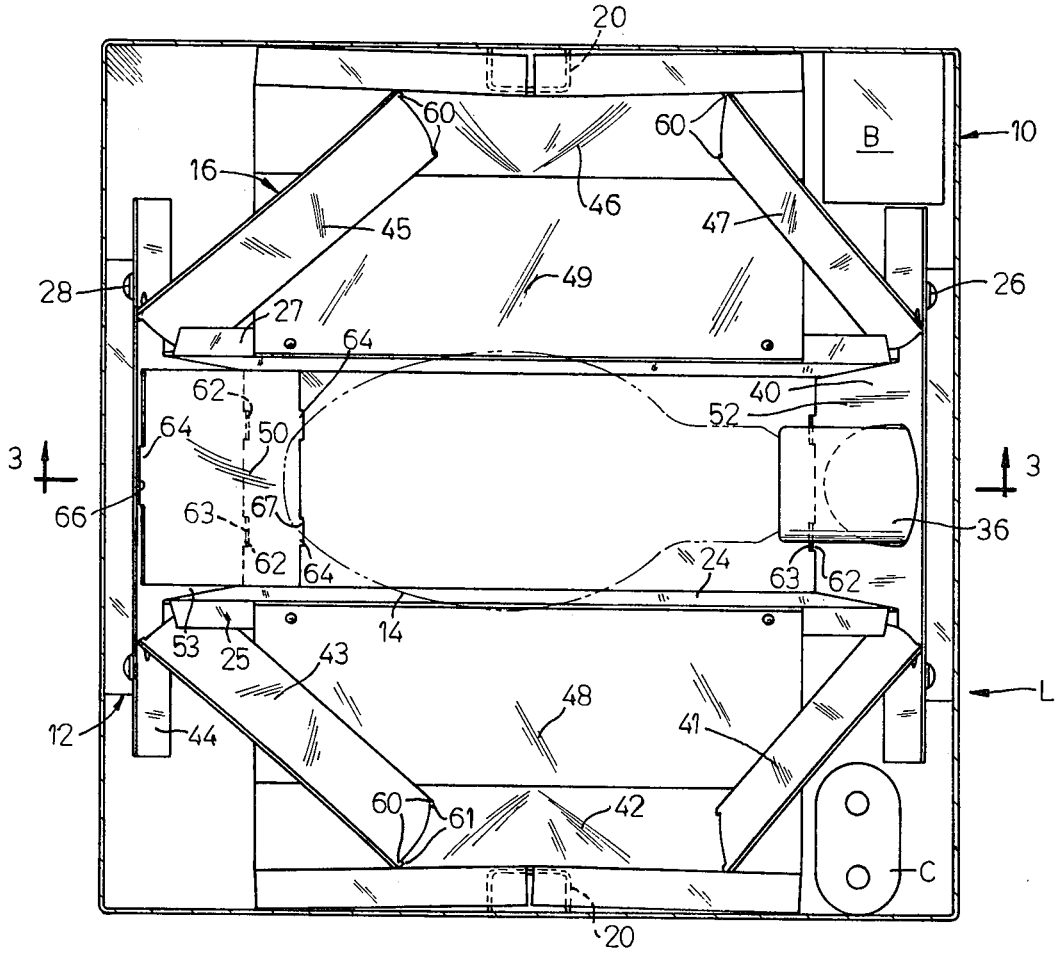
FIG. 2 is a cross-sectional plan view of the light fixture shown in FIG. 1.
Figure 3:
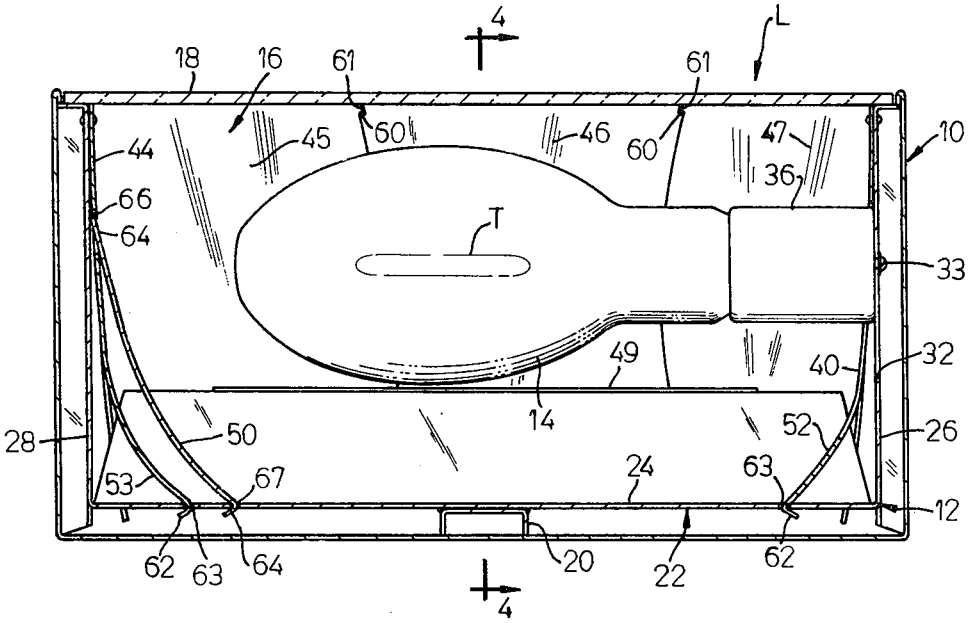
FIG. 3 is a cross-sectional view taken generally along the line 3—3 in FIG. 2.

The fixture housing 10, as best shown in FIG. 2, comprises a generally square structure, and functions as both a protective covering for housing the various elements of the light fixture and as a decorative configuration. The fixture housing 10 illustrated, is shown as being large enough to receive the reflector cradle 12, the reflector assembly 16, the lamp 14, the ballast B and the capacitor C. The ballast B and capacitor C could also be mounted remotely if it were desirable to do so.

The high intensity lamp 14 used in the light fixture may be comprised of any of the metal halide, mercury or high pressure sodium type lamps. The light fixture is provided, however, to support the generally elongated lamp 14 in a horizontal position and is thus particularly adapted for use with the newly developed high intensity lamps such as the Super-Metalarc lamps produced by Sylvania of Danvers, Massachusetts which are particularly efficient but which are restricted to use in a horizontal relationship.

Figure 4:
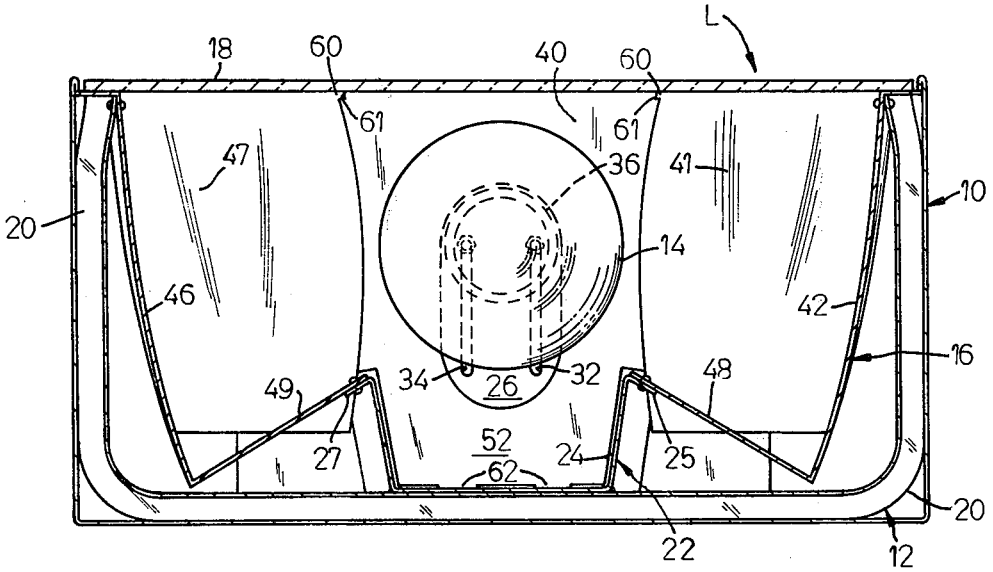
FIG. 4 is a cross-sectional view taken generally along the line 4—4 in FIG. 3.
Figure 5:
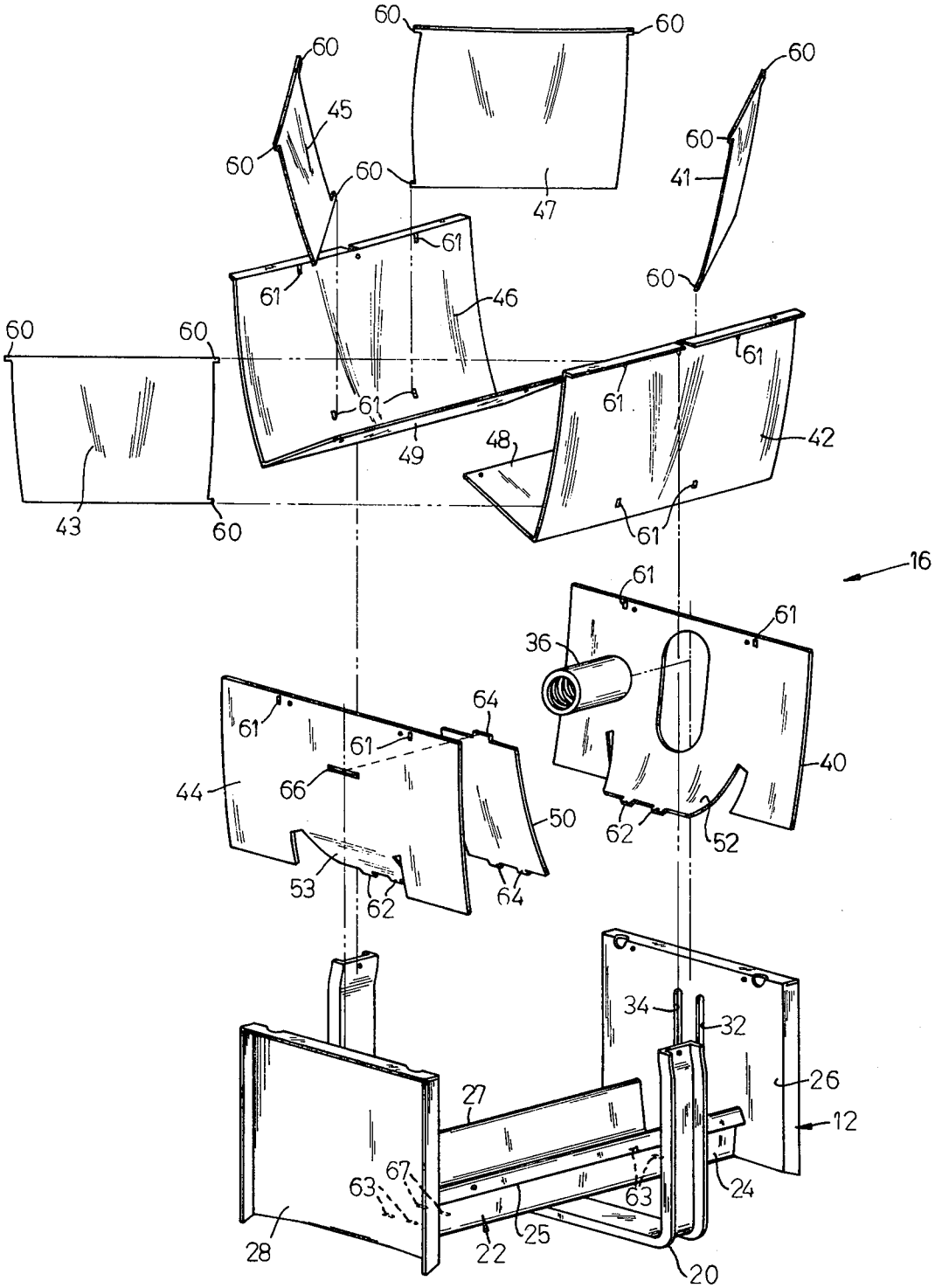
FIG. 5 is an exploded isometric view of the reflector cradle and the reflector assembly of the light fixture of the present invention.

As best shown in FIG. 5, the reflector cradle 12 which supports the reflector assembly 16, includes a generally U-shaped angular bracket 20, extending in a direction generally perpendicular to the axis of the lamp 14, and an elongated base member 22 which extends below and parallel to the lamp 14. The U-shaped angular bracket 20 and the elongated base member 22 are rigidly joined together and are positioned to provide support for the reflector assembly 16. The elongated base member 22 is comprised of a trough portion 24 disposed below the lamp 14 and extending parallel to it, and two vertically extending end walls 26 and 28 integrally attached to opposite ends of the trough portion 24. As shown in FIG. 4, the trough portion 24 is defined by a bottom wall and opposed spaced apart vertical side walls, each of the side walls being integrally connected at their lower edge to the bottom wall and being connected at their upper portions to the reflector assembly. The reflector cradle 12 is intended merely as a means of supporting the reflector assembly and other similar means are also within the scope of the invention.

The end wall 26 of the reflector cradle 12 includes a pair of centrally disposed vertically extending spaced parallel slots 32 and 34 which permit a lamp socket 36 to be vertically slideably supported by the end wall. A pair of screws 33, which are received through the parallel slots 32 and 34, are threadably received within the base of the lamp socket 36 and function to secure the lamp socket against the end wall 26.

The reflector assembly 16 which is received within the reflector cradle 12, defines, as shown in FIG. 2, a generally eight-sided octagonal configuration, surrounding the lamp 14, and comprised of a plurality of independent reflector panels 40–50. More specifically, the reflector assembly 16 includes eight reflector panels 40–47 which are generally vertically disposed and which surround the lamp 14 in the said octagonal configuration, two opposed angularly disposed lower reflector panels 48 and 49, and a concave reflector panel 50 positioned adjacent to the lower portion of the end reflector panel 44. Each of the reflector panels 40–50 is comprised of aluminum sheet material having highly polished reflector surfaces facing the lamp with reflection properties on the order of 85-90%. The size of the reflector assembly 16 and each of the reflector panels 40–50 vary in direct proportion to the size and length of the arc tube T of the lamp 14. The shape and arrangement of the reflector panels, however, does not change and is equally useful for lamps of 250–1,000 watts.

The reflector panels 42 and 46, which are disposed in vertically extending generally parallel relationship at each side of the lamp 14, are secured at their upper edge by rivets to the upper portion of the ends of the U-shaped bracket 20 and include slightly concave-convex reflector surfaces. More specifically, each of these surfaces are slightly convex with respect to the lamp 14 when viewed in plan, and concave when viewed in a cross-sectional end elevation as shown in FIG. 4.

As also shown in FIG. 4, the two angularly disposed lower reflector panels 48 and 49, which are provided in intersecting relationship to the reflector panels 42 and 46 respectively, are integrally connected thereto at their lower edges to define a V-shaped configuration. The lower reflector panels 48 and 49 each slope generally upwardly toward the lamp 14, such that they generally lie in a plane extending radially outwardly from the lamp and are rigidly connected at their upper edges to the lips 25 and 27 extending along the upper edges of the trough 24.

The reflector panels 40 and 44 disposed adjacent opposite ends of the lamp 14 are respectively riveted at points adjacent their upper edge to the end walls 26 and 28. Both of the panels 40 and 44 are generally vertically disposed but include concave lower portions 52 and 53 respectively. The reflector panel 40 is also provided with an elongated oval slot which receives the lamp socket 36 therein.

Each of the reflector panels 41 and 47 are generally vertically disposed and extend in a diagonal relationship with respect to the reflector panels 40 and 42 and with respect to the panels 40 and 46 respectively. Though these panels are generally planar, they are seen to be slightly convex with respect to the lamp 14 when viewed in plan. The panels 43 and 45 are similar to the panels 41 and 47 except that they are more nearly planar.

The purpose of the specific arrangement of the reflective panels with respect to the lamp is to reflect the light emitted by the lamp such that the intensity of the light striking each point of the illuminated area is substantially equal. Some of the light emitted by the lamp will, of course, shine directly on the ceiling or reflecting surface, and in the absence of reflector means, the area of the reflecting surface directly above the lamp and closest to it will receive light at relatively high intensity compared to the areas of the surfaces which are further away from the lamp. More specifically, since the intensity of light emanating from a point is inversely proportional to the square of the distance between the light source and the point where intensity is measured, in the absence of reflector means, the intensity of the light at points spaced further away from the lamp will decrease substantially with radial outward distance. It is thus desirable, in order to evently distribute the light intensity across the illuminated surface, to direct proportionately greater amounts of light toward the periphery of the area illuminated. The surfaces of the reflector panels are thus particularly positioned and specifically shaped to direct increasing proportions of the light radially outwardly with respect to the opposed reflecting surface so that the light is evenly distributed across that surface.

The trough 24 is also specifically shaped in order to further provide even distribution of light against the opposed illuminated surface. The trough 24 has a diffuse reflective surface in order that the light projected downwardly from the lamp against surface of the trough 24 is not reflected directly against the illuminated area of the reflecting surface but instead is diffused such that it will strike the various panels of the reflecting assembly 16.

Each of the diagonally disposed reflector panels 41, 43, 45 and 47 are provided with horizontally projecting tabs 60 which extend from their vertical edges and which are receivable in complementary slots 61 in the reflector panels 40, 42, 44 and 46. The lower horizontal edges of the concave reflector portions 52 and 53 of the panels 40 and 44, respectively, also include tabs 62 receivable in complementary slots 63 in the trough 24. The upper and lower horizontal edges of the concave reflector panel 50 also include tabs 64 which are receivable within slot 66 in the reflector panel 44 and slots 67 in the trough 24 respectively.

As previously stated, the lamp 14 is mounted for vertical sliding movement with respect to the end wall 26. Vertically adjusting the position of the lamp 14 has the advantage that it permits the size of the area of the reflecting surface which is illuminated to be varied and also permits the intensity of the light thereon to be varied.

As also previously stated, the light assembly of the present invention can further include a refractory lense 18 disposed over the lamp 14 and the reflector assembly 16 in order to further diversify the light emitted by the lamp and to evenly disperse the light across the reflecting surface. A particularly effective lense for this purpose is comprised of ASG Crystal 76 produced by ASG Industries, Inc., Kingsport, Tenn.

Figure 6:
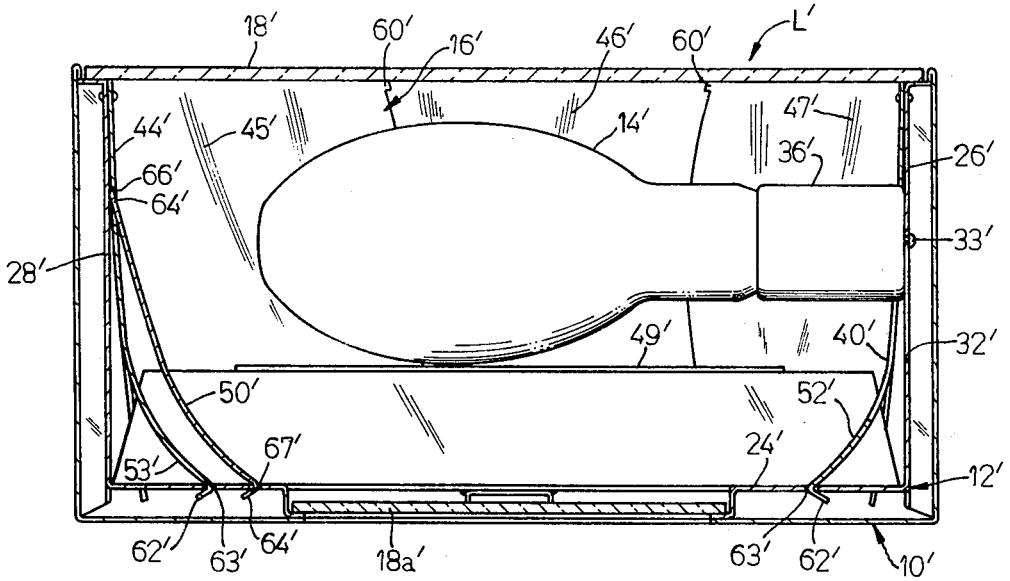
FIG. 6 is a view similar to FIG. 3 but showing a second embodiment of the present invention.

FIG. 6 illustrates an alternative embodiment of the present invention wherein the reflector cradle 12' and the fixture housing 10' are constructed in order to permit the lamp 14' to emit light through the bottom of the light fixture to provide direct lighting as well as indirect lighting. It should be noted that modifying the reflector trough 24' and the fixture housing 10' to include a lower refractory lense 18a' to permit light to pass through the bottom of the fixture does not significantly effect the photometrics produced by the reflector assembly 16' directing light against the ceiling since the light which is reflected by the reflector assembly is generally that light which is directed laterally outwardly rather than the light which is directed downwardly toward the trough 24'.

Figure 7:
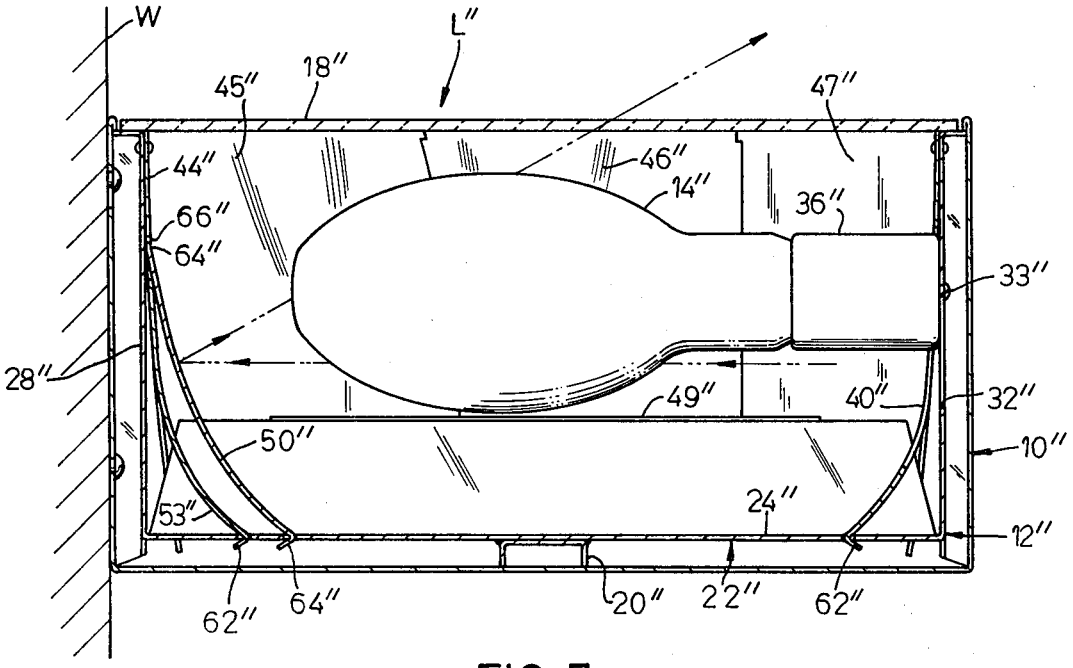
FIG. 7 is another view similar to that shown in FIG. 3 but showing a third embodiment of the invention wherein the light fixture is intended to be secured to a wall.

FIG. 7 shows another alternative embodiment of the present invention wherein the light fixture L" is secured to a wall W. The light fixture L" is substantially the same as that previously described except that the reflectors 41" and 47" are positioned so that light striking those reflectors is not directed upwardly against a reflecting surface but rather is directed against the reflectors 43"–45" and 50" and thus outwardly away from the wall toward the ceiling as shown by the arrows.

RESUME

The apparatus of the present invention thus provides an improved light fixture for use in indirect lighting which is a convenient, compact and efficient means of lighting a room.

The light fixture includes an octagonal array of independently mounted reflector surfaces which surround a high intensity lamp and which reflect the light emitted by the lamp against a reflecting surface in an evenly distributed pattern. The reflector surfaces are particularly designed to form a compact configuration around the lamp yet to illuminate a relatively large area of the reflecting surface even though they are disposed relatively close to that reflecting surface. The reflector assembly is also particularly advantageous in that it directs the light against the reflecting surface in such a manner that the light intensity striking specific areas of that portion of the reflecting surface which is illuminated is distributed uniformly across that illuminated area. The efficiency of the lighting fixture and the light distributed by the reflecting surface is thus maximized. The lighting fixtures of the present invention are sufficiently practical that they can be used to replace direct overhead lighting thereby avoiding construction costs of built-in overhead lighting and producing the more desirable lighting effect inherent in indirect lighting.

We claim:

1. A light fixture for use with a light emitting lamp for indirect lighting, said light fixture comprising: reflector means surrounding portions of said lamp for reflecting said light against an area of an opposed surface and for distributing said light across said area in a uniformly distributed intensity; and reflector support means including means for supporting said lamp; said reflector means including a plurality of independently angularly positioned reflector panels defining an octagonal configuration around said lamp, and said plurality of reflector panels including opposed generally V-shaped reflector panels extending along opposite sides of said lamp, said V-shaped panels each including a pair of angularly disposed intersecting reflector surfaces, one of said surfaces being positioned generally normal to the direction of the light emitted by the lamp and striking said one surface and the other of said surfaces generally lying in a plane extending radially outwardly from said lamp, at least one of said plurality of independently angularly positioned reflector panels being positioned diagonally with respect to said one surface, and wherein said plurality of independently angularly positioned reflector panels include opposed end reflector panels disposed adjacent opposite ends of said V-shaped reflector panels, said V-shaped reflector panels and said end reflector panels being joined by diagonally disposed reflector panels.

2. The light fixture set forth in claim 1 wherein said reflector support means includes a trough shaped member disposed parallel to and opposite said lamp, said trough shaped member being connected to said V-shaped reflector panels.

3. A light fixture for use with a light emitting lamp in indirect lighting and comprising: reflector means surrounding portions of said lamp for directing said light against an area of an opposed surface and for distributing said light across said area in uniform intensity, and reflector support means, said reflector means including a plurality of independently angularly positioned reflector panels defining an octagonal configuration around said lamp and each of said panels having a reflector surface facing said lamp, said plurality of reflector panels including a pair of opposed side reflector panels disposed on opposite sides of said lamp, each opposed side reflector panel defining generally V-shaped angularly disposed reflector surfaces, end reflector panels disposed adjacent opposite ends of said side reflector panels and generally normal thereto, and diagonally positioned reflector panels connecting said side reflector panels to said end reflector panels, said reflector support means including a trough shaped member disposed opposite one side of said lamp and being positioned between and joined to said opposed side reflector panels, said trough shaped member including a bottom wall and opposed spaced apart side walls, each of said side walls being connected to said bottom wall.

4. A light fixture for use with a light emitting lamp in indirect lighting and comprising: reflector means surrounding portions of said lamp for directing said light against an area of an opposed surface and for distributing said light across said area in uniform intensity, and reflector support means, said reflector means including a plurality of independently angularly positioned reflector panels each having reflector surfaces, said reflector panels including a pair of opposed side reflector panels disposed parallel to and on opposite sides of said lamp, end reflector panels disposed adjacent opposite ends of said side reflector panels and generally normal thereto, and diagonally positioned reflector panels connecting said side reflector panels to said end reflector panels, said reflector support means including a trough-shaped member disposed opposite one side of said lamp and being positioned between and joined to said opposed side-reflector panels, and said end reflector panels including concave lower portions.

5. A light fixture for use with a light emitting lamp in indirect lighting and comprising: reflector means surrounding portions of said lamp for directing said light against an area of an opposed surface and for distributing said light across said area in uniform intensity, and reflector support means, said reflector means including a plurality of independently angularly positioned reflector panels each having reflector surfaces, said reflector panels including a pair of opposed side reflector panels disposed parallel to and on opposite sides of said lamp, end reflector panels disposed adjacent opposite ends of said side reflector panels and generally normal thereto, and diagonally positioned reflector panels connecting said side reflector panels to said end reflector panels, said reflector support means including a trough-shaped member disposed opposite one side of said lamp and being positioned between and joined to said opposed side reflector panels, said opposed side reflector panels including concave-convex reflecting surfaces facing said lamp.

6. A compact light fixture for use with an elongated high intensity light emitting lamp having an arc tube and for use in directing light against a surface in a uniform distribution, said light fixture comprising:

reflector means surrounding said lamp and providing means for directing light emitted by said lamp against said surface and for evenly distributing light intensity across said surface;

and reflector support means including means for supporting said lamp in a horizontally disposed position;

said reflector means comprising a plurality of contoured reflector panels arranged in angularly oriented mutually adjacent positions around said lamp, said reflector means including a pair of opposed generally V-shaped reflector panels extending along opposite sides of said lamp, said V-shaped panels each including a pair of angularly disposed intersecting reflector surfaces, one of said surfaces being positioned generally normal to the direction of the light emitted by the lamp and striking said one surface and the other of said surfaces generally lying in a plane extending radially outwardly from said lamp, said reflector means further including a pair of end reflector panels disposed adjacent opposite ends of said V-shaped panels and generally normal to said V-shaped panels, and diagonally positioned generally vertically extending reflector panels connecting said V-shaped reflector panels to said end reflector panels, at least one of said diagonally positioned reflector panels having a convex reflecting surface facing said lamp.

7. The light fixture set forth in claim 6 wherein said reflector support means includes a trough shaped member disposed parallel to and below said lamp, said trough shaped member being connected to said V-shaped reflector panels.

8. A light fixture for use with a light emitting lamp for indirect lighting, said light fixture comprising: reflector means surrounding portions of said lamp for reflecting said light against an area of an opposed surface and for distributing said light across said area in a uniformly distributed intensity; and reflector support means including means for supporting said lamp; said reflector means including a plurality of independently angularly positioned reflector panels including opposed generally V-shaped reflector panels extending along opposite sides of said lamp, said V-shaped panels each including a pair of angularly disposed intersecting reflector surfaces, one of said surfaces being positioned generally normal to the direction of the light emitted by the lamp and striking said one surface and the other of said surfaces generally lying in a plane extending radially outwardly from said lamp, said reflector means including at least one reflector panel positioned diagonally with respect to said one of said surfaces, the said one reflector panel positioned diagonally having a convex reflecting surface facing said lamp.

9. A light fixture for use with a light emitting lamp for indirect lighting, said light fixture comprising: reflector means surrounding portions of said lamp for reflecting said light against an area of an opposed surface and for distributing said light across said area in a uniformly distributed intensity; and reflector support means including means for supporting said lamp; said reflector means including a plurality of independently angularly positioned reflector panels including opposed generally V-shaped reflector panels extending along opposite sides of said lamp, said V-shaped panels each including a pair of angularly disposed intersecting reflector surfaces, one of said surfaces being positioned generally normal to the direction of the light emitted by the lamp and striking said one surface and the other of said surface generally lying in a plane extending radially outwardly from said lamp, and said plurality of angularly positioned reflector panels further including opposed end reflector panels disposed adjacent opposite ends of said V-shaped reflector panels, said end reflector panels each including a reflecting surface concave when viewed in elevation, said V-shaped reflector panels and said end reflector panels being joined by diagonally disposed reflector panels.

* * * * *